US007272338B2

(12) United States Patent
Karasawa et al.

(10) Patent No.: US 7,272,338 B2
(45) Date of Patent: Sep. 18, 2007

(54) IMAGE FORMING APPARATUS HAVING A PROJECTION PROVIDED ON A BOTTOM FACE OF AN UPPER CASING

(75) Inventors: Takashi Karasawa, Nagano (JP); Toru Nakazawa, Nagano (JP); Tsuyoshi Miyawaki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 73 days.

(21) Appl. No.: 11/177,786

(22) Filed: Jul. 8, 2005

(65) Prior Publication Data

US 2006/0056875 A1 Mar. 16, 2006

(30) Foreign Application Priority Data

Jul. 9, 2004 (JP) ..... 2004-202950

(51) Int. Cl.
*G03G 15/00* (2006.01)
*G03G 21/16* (2006.01)

(52) U.S. Cl. ..... 399/107; 399/125; 399/367

(58) Field of Classification Search ..... 399/107, 399/110, 124, 125, 367
See application file for complete search history.

(56) References Cited

U.S. PATENT DOCUMENTS

| | | | | |
|---|---|---|---|---|
| 5,276,480 | A * | 1/1994 | Takahashi | 399/125 |
| 5,897,244 | A * | 4/1999 | Miyazaki et al. | 399/124 X |
| 6,510,301 | B2 * | 1/2003 | Tanaka | 399/125 |
| 6,674,983 | B2 * | 1/2004 | Enomoto et al. | 399/124 |
| 6,741,820 | B2 * | 5/2004 | Nobe et al. | 399/110 |
| 6,768,893 | B1 * | 7/2004 | Andersen et al. | 399/367 |

* cited by examiner

*Primary Examiner*—Sandra L. Brase
(74) *Attorney, Agent, or Firm*—John J. Penny, Jr.; Edwards Angell Palmer & Dodge LLP

(57) ABSTRACT

A prop is extending from the printer unit upwards. A rear end portion of an upper casing is coupled with an upper portion of the prop pivotably in a vertical direction. A transparent platen is provided on a top face of the upper casing. An image capturer is provided in the upper casing and operable to capture an image on an original disposed on the platen and to output image data. A projection is provided on a bottom face of the upper casing and is extending in a front-rear direction of the upper casing. The projection has a rear end face adapted to be supported by the prop when the upper casing is placed in a first position causing the platen to extend horizontally. The rear end face extends obliquely in a forward-downward direction.

6 Claims, 12 Drawing Sheets

IMAGE FORMING APPARATUS HAVING A PROJECTION PROVIDED ON A BOTTOM FACE OF AN UPPER CASING

BACKGROUND OF THE INVENTION

The present invention relates to an image forming apparatus.

As an image forming apparatus including a printer and an image scanner which can be operated independently or under control of a personal computer (PC), such as a so-called hybrid machine, there has been known such a structure that a scanner unit is mounted on a top plate of a rack, and a printer unit provided with a caster is installed below the top plate. When an original such as a bound book is to be read, a user will strongly press the original against an original table for enhancing tightness of contact between the original and the original table. For this reason, the top plate on which the scanner unit is mounted, and a connecting structure between the top plate and a prop are required to have high rigidity.

By holding the scanner unit on the top plate of the rack, it is possible to secure a space above the printer unit and to eject printed sheets of paper onto an upper face of the printer unit, which will make the image forming apparatus more compact, as compared with a case where a sheet ejection tray is provided on a side face. Moreover, because the top plate on which the scanner unit is mounted is supported by the prop in a cantilevered manner, the space between the top plate and the printer unit is made open in three directions, and operability in taking out the printed sheets will be improved.

However, in the structure where the rack for holding the scanner unit is a separate body from the printer unit, and the printer unit must be pulled out from underneath of the top plate of the rack on each occasion of performing maintenance, for example, removal of jammed sheets or replenishment of toner, there has been such a problem that a moving space for the printer unit must be kept around the image forming apparatus.

SUMMARY OF THE INVENTION

It is therefore an object of the invention to provide an image forming apparatus which requires a small installation space, and has excellent operability on occasion of taking out sheets of paper and performing maintenance.

In order to achieve the above object, according to the invention, there is provided an image forming apparatus, comprising:

a printer unit;

a prop, extending from the printer unit upwards;

an upper casing, a rear end portion of which is coupled with an upper portion of the prop pivotably in a vertical direction;

a transparent platen, provided on a top face of the upper casing;

an image capturer, provided in the upper casing and operable to capture an image on an original disposed on the platen and to output image data; and a projection, provided on a bottom face of the upper casing and extending in a front-rear direction of the upper casing, the projection having a rear end face adapted to be supported by the prop when the upper casing is placed in a first position causing the platen to extend horizontally, wherein the rear end face extends obliquely in a forward-downward direction.

With this structure, it is possible to enhance rigidity of the upper casing without supporting a front part of the upper casing. Moreover, by pivotably connecting the upper casing which contains the image capturer to the prop, it will be easy to work in an upper part of the printer unit on occasion of performing maintenance or so, and there will be no necessity of moving the printer unit for maintenance purpose. As the results, space for installation will be decreased.

Preferably, a lower end face of the projection obliquely extends from a lower end of the rear end face in a forward-upward direction.

Preferably, the prop has a front end face obliquely extends in a forward-downward direction, so that the rear end face of the projection comes in contact with the front end face when the upper casing is placed in the first position.

Preferably, the prop has a top end face adapted to support a portion of the bottom face of the upper casing that is closer to a rear end of the upper casing than the projection, when the upper casing is placed in the first position.

Preferably, the printer unit is configured to eject a printing medium from a top portion thereof. In this case, space for installation will be decreased.

Preferably, the printer unit comprises: a lower casing, having an opening at a top portion thereof; a cover, coupled with the lower casing pivotably in the vertical direction and adapted to open or close the opening; and a print engine, accommodate in the lower casing so as to be exposed from the opening when the cover opens the opening, and operable to print the image data on a printing medium.

With this structure, the user can make use of a large space above the printer unit in a state where the upper casing and cover have been lifted, and workability for maintenance such as removal of the jammed sheets or exchange of the toner will be improved.

DETAILED DESCRIPTION OF EMBODIMENTS

Embodiments of the invention will be described below in detail with reference to the accompanying drawings.

Figure 2:
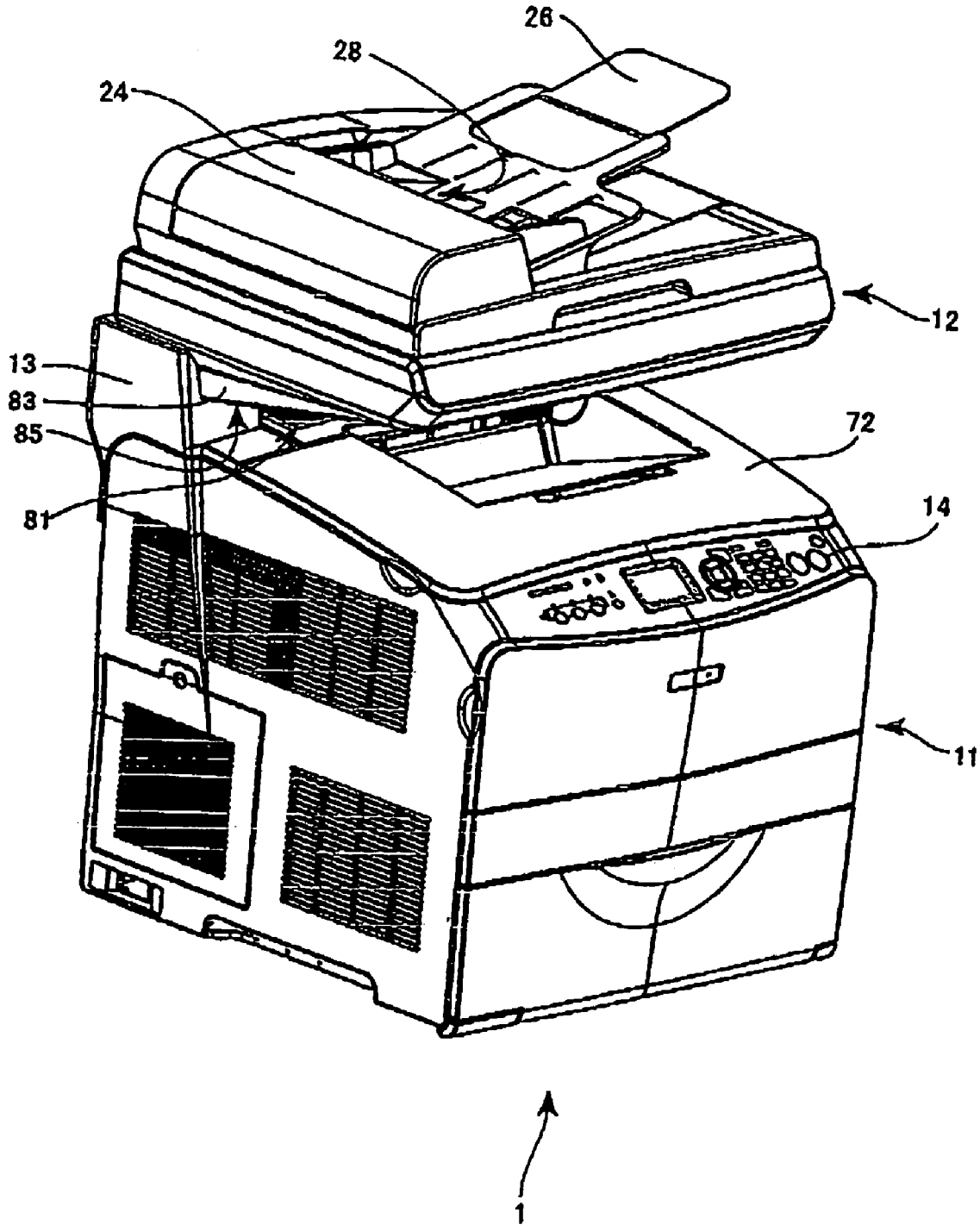
FIG. 2 is a perspective view of the hybrid machine of FIG. 1.

FIG. 2 is a perspective view showing an external appearance of a hybrid machine 1 as an image forming apparatus according to a first embodiment of the invention. The hybrid machine 1 includes a scanner unit 12 for reading an original, an ASF (Automatic Sheet Feeding) unit 24, a printer unit 11 for printing an image which has been read, and props 13. The scanner unit 12 is pivotably connected to upper parts of the props 13. The props 13 are fixed to an upper part of the printer unit 11 so as to tiltably support the scanner unit 12. It is to be noted that the props 13 need not be fixed to the printer unit 11, but may be independently provided on an installation plane of the hybrid machine 1.

Figure 3:
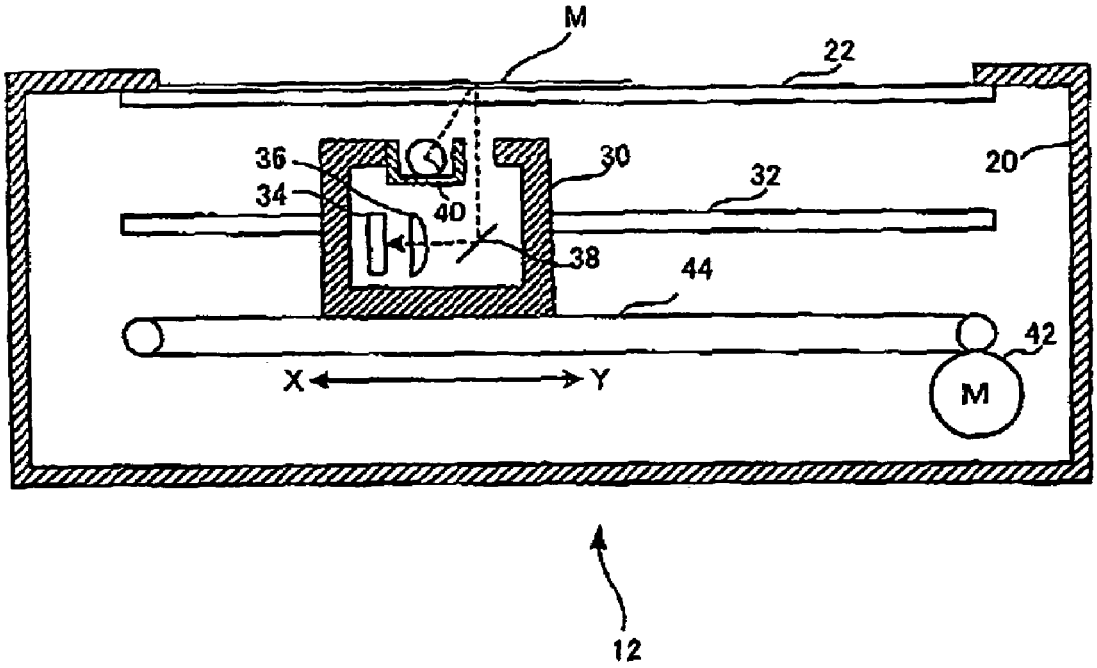
FIG. 3 is a schematic view of a scanner unit in the hybrid machine of FIG. 1.

FIG. 3 is a schematic view showing an interior structure of the scanner unit 12. A box-shaped scanner casing 20 as an upper casing is open in its upper part, and connected to the props 13 so as to pivot by hinges, which are not shown. An original table 22 is a transparent glass plate which covers the opening formed in the upper part of the scanner casing 20, and is fixed to the scanner casing 20. An original M is placed on a table face of the original table 22.

A box-shaped carriage 30 is contained inside the scanner casing 20. The carriage 30 is slidably held by a rod-shaped carriage guide 32 which is fixed to the scanner casing 20. The carriage 30 is locked to a belt 44 which is driven by a motor 42. The carriage 30 reciprocally moves in an axial direction of the carriage guide 32 with circulation of the belt 44.

Inside the carriage 30, there are contained a scanning circuit board 34 equipped with a linear image sensor, a lens 36, a mirror 38, and a light source 40. The light source 40 illuminates the original near a scanning line, and the mirror 38 and the lens 36 form an image of reflective light of the illuminated original M on the scanning line, on a light receiving face of the scanning circuit board 34. The linear image sensor is mounted on the scanning circuit board 34 in such a manner that light receiving elements of respective colors, red, green and blue are rectilinearly arranged. The linear image sensor outputs electric signals corresponding to degree of light of the optical image which has been formed on the light receiving face. The electric signals outputted from the linear image sensor is converted to digital image data in an analogue front end section and a digital image processing section, which are not shown. The above described carriage 30, carriage guide 32, motor 42, belt 44, scanning circuit board 34, lens 36, mirror 38 and light source 40 constitute an image capturer.

Figure 4:
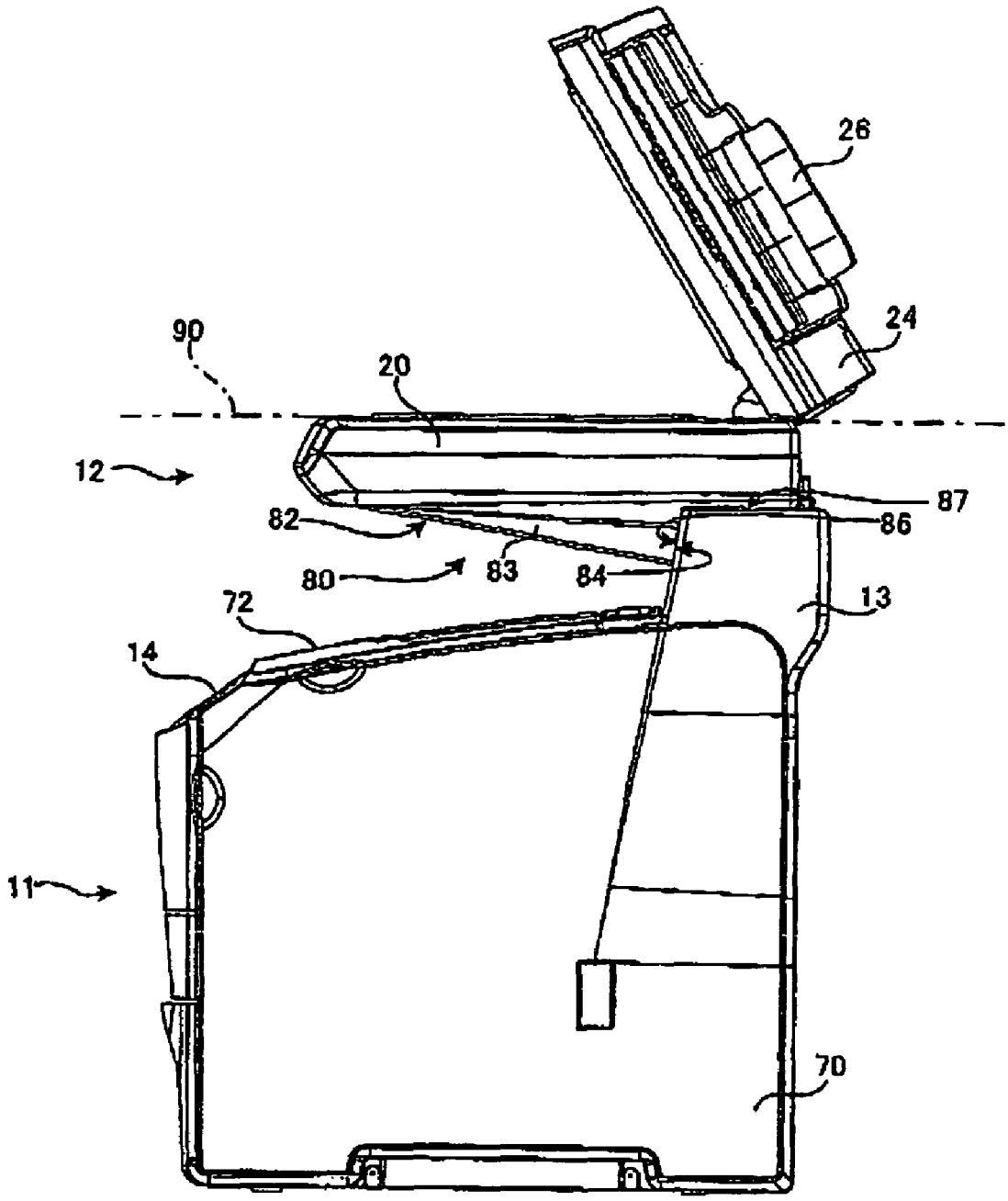
FIG. 4 is a side view showing a state that the scanner unit in the hybrid of FIG. 1 is opened.

The ASF unit 24 is pivotably connected to the scanner casing 20 so as to make the table face of the original table 22 free, as shown in FIG. 4. The ASF unit 24 conveys the original which has been placed on a sheet supporting plate 26, from an inlet 28 to the table face of the original table 22.

Figure 5:
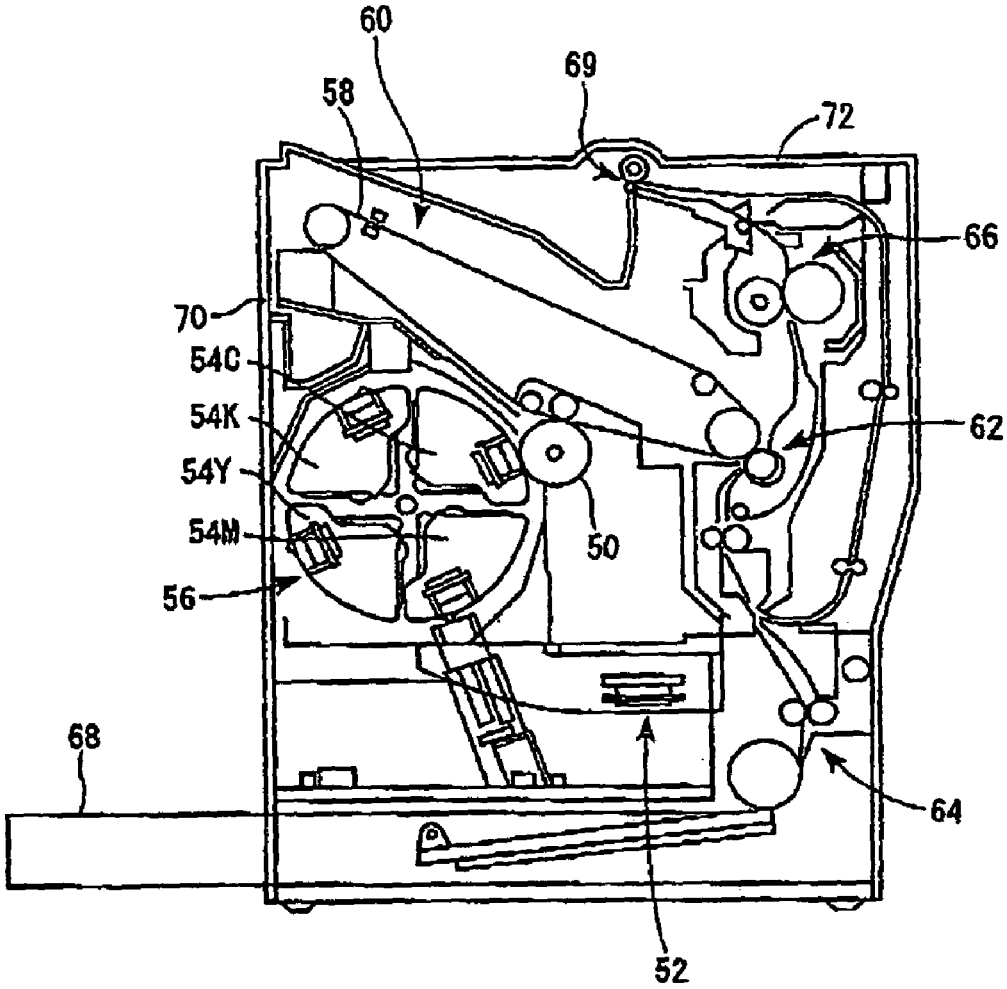
FIG. 5 is a schematic section view of the printer unit of FIG. 1.

FIG. 5 is a schematic view showing an interior structure of the printer unit 11. A printer casing 70 as a lower casing contains a printing section of various printing systems such as a laser system, an inkjet system and so on. A structure of the printing section will be described hereunder referring to the printing section of color laser system, as an example. An exposing device 52 irradiates laser to a photosensitive body 50 which has been electrified with electrostatic latent images of respective colors, such as cyan (C), magenta (M), yellow (Y), black (K), thereby to form the electrostatic latent images. A developing device 56 develops the electrostatic latent images formed on the photosensitive body 50 as toner images, by using toners of different colors which are supplied from toner cartridges 54C, 54M, 54Y, 54K of the respective colors mounted on the printer unit 11. A primary transfer unit 60 transfers the toner images of the respective colors which have been developed on the photosensitive body 50 to a transfer belt 58 thereby to form a color toner image. A conveying unit 64 conveys sheets of paper from a sheet cassette 68. A secondary transfer unit 62 transfers the color toner image formed on the transfer belt 58 to the sheet of paper which has been conveyed. A fuser unit 66 fuses the transferred color toner image with the sheet of paper, and ejects it from an outlet 69. The structure of the printing section contained in the printer casing 70 has been described above.

Figure 1:
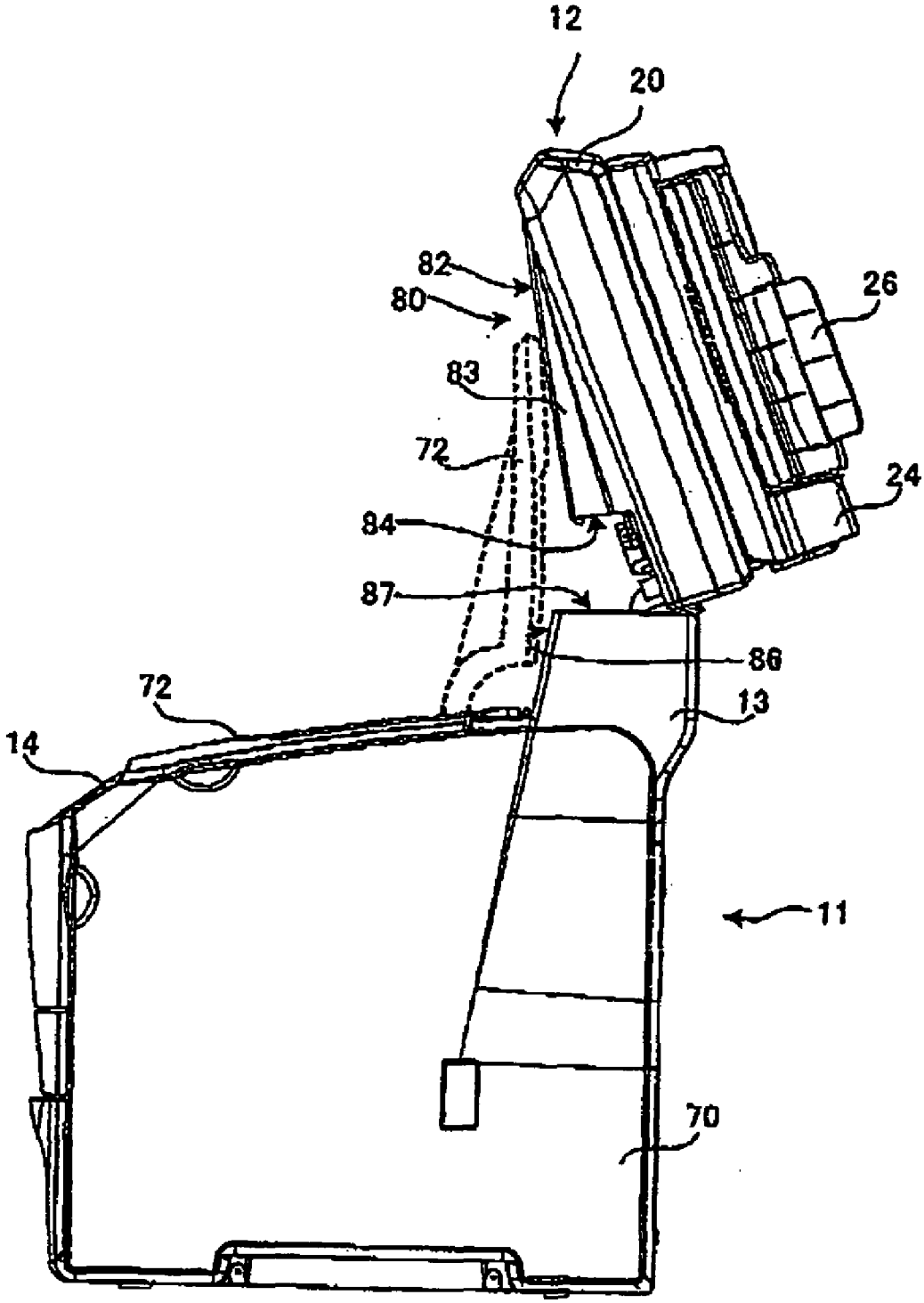
FIG. 1 is a side view showing a state that a printer unit in a hybrid machine according to a first embodiment of the invention is opened.
Figure 6:
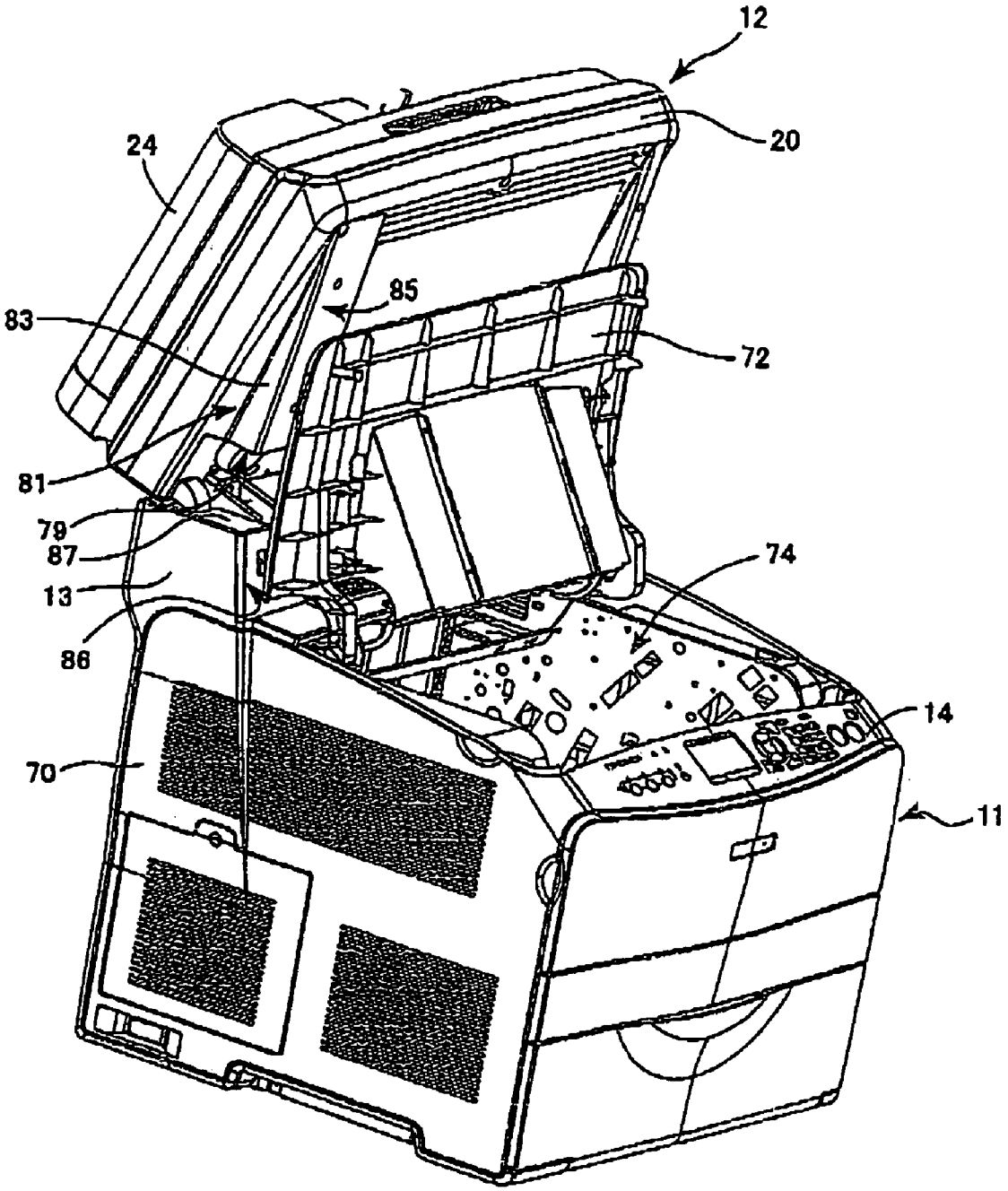
FIG. 6 is a perspective view showing a state that the inside of the printer unit in the hybrid machine of FIG. 1 is opened.

FIGS. 1 and 6 are a side view and a perspective view respectively showing a hybrid machine 1 in a state where the scanner unit 12 and a printer cover 72 are fully opened. An opening 74 is formed in an upper part of the printer casing 70. The printer cover 72 is pivotably connected to the printer casing 70 so that the opening 74 of the printer casing 70 can be covered in a fully closed state of the printer cover 72. When a front end part of the scanner unit 12 is lifted, an upper part of the printer unit 11 is opened, and therefore, it is possible to extensively pivot the printer cover 72 in an opening direction. Then, the printing section (omitted in FIG. 6) is exposed from the opening 74, and the upper part of the printer unit 11 is extensively opened. Therefore, it is easy to insert a hand or a tool into the printer casing 70, which facilitates maintenance of the printing section.

A control panel 14 is fixed to the upper part of the printer casing 70. The control panel 14 is provided with buttons for various operations, LCDs and so on, and receives various orders from the user, such as setting of copying conditions.

Figure 7:
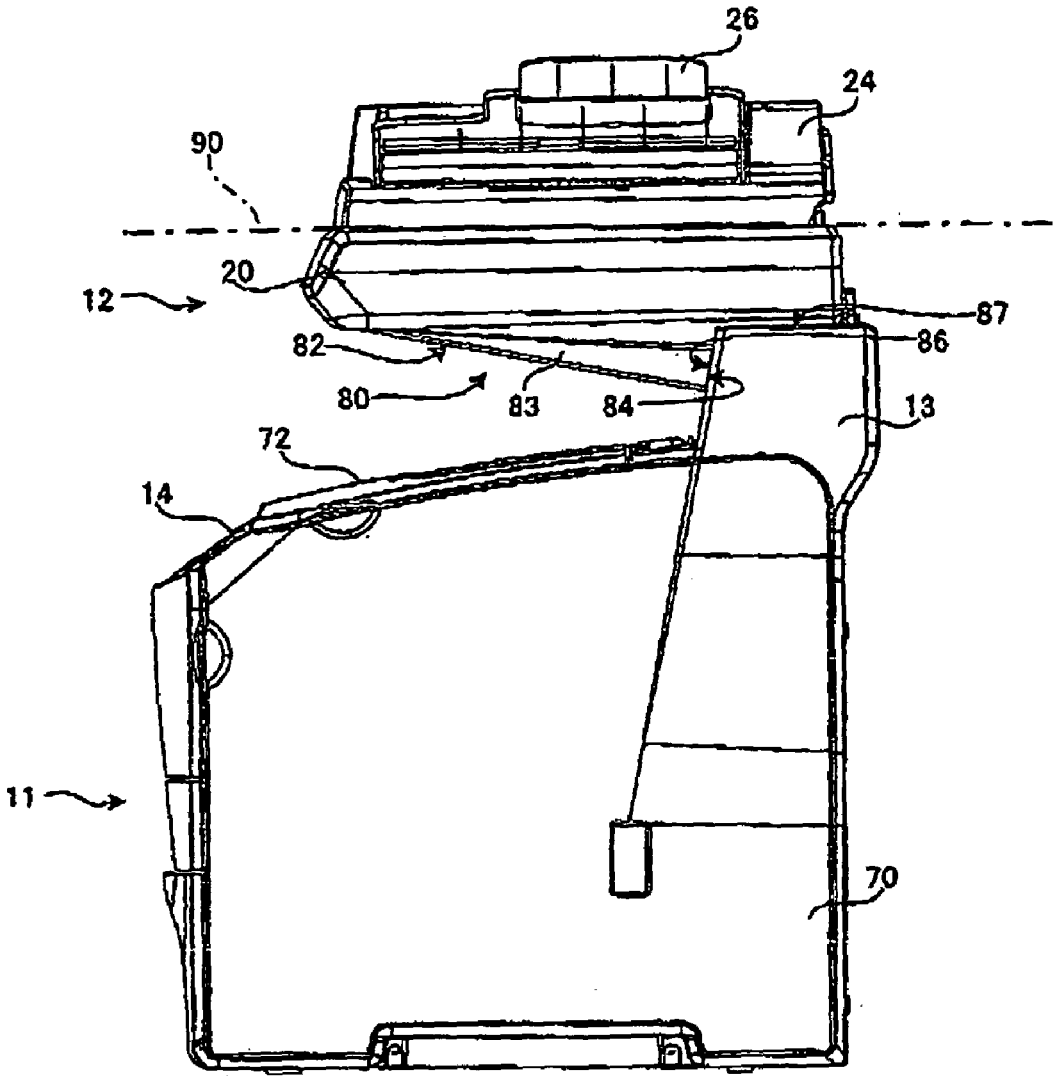
FIG. 7 is a side view showing a state that the scanner unit in the hybrid machine of FIG. 1 is closed.
Figure 8:
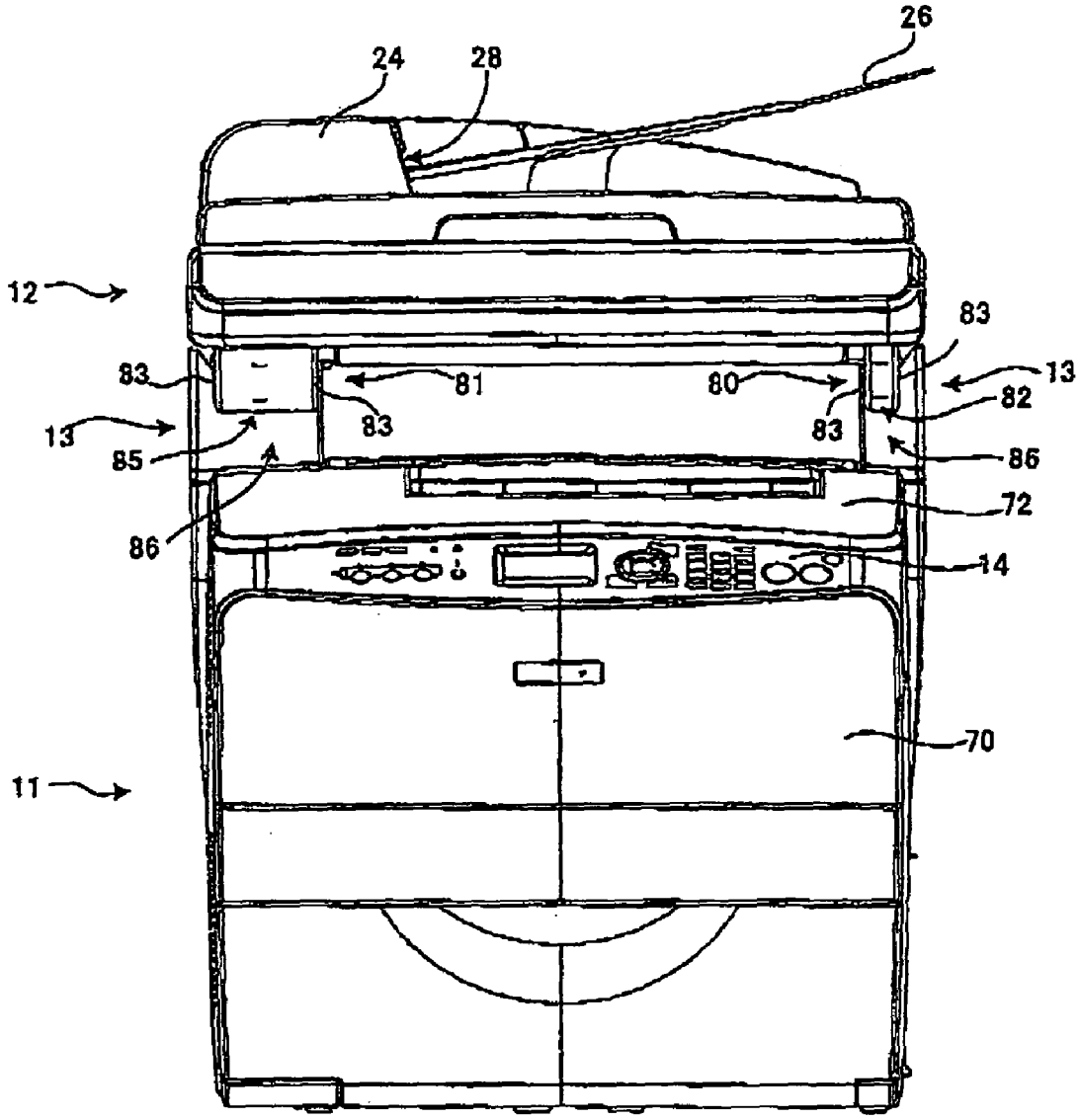
FIG. 8 is a front view showing the state shown in FIG. 7.

FIG. 7 is a side view of the hybrid machine 1. FIG. 8 is a front view of the hybrid machine 1. For the purpose of enhancing rigidity of the scanner casing 20, the scanner casing 20 is provided with projections 80, 81 at two positions on its bottom face. Side walls 83 of both the projections 80, 81 are in a shape of triangular plate, extending in parallel to each other from a front end to a back end of the scanner casing 20 and at a right angle with respect to a plane 90 including a table face of the original table 22. Therefore, lower end walls 82, 85 in front parts of the projections 80, 81 are inclined downward in a direction from a front face to a back face of the hybrid machine 1. In other words, a space between the scanner casing 20 and the printer unit 11 is larger in the front face side of the image forming apparatus, and thus, operability has been improved. Although the projections 80, 81 are provided at the two positions on the bottom face of the scanner casing 20 in this embodiment, the scanner casing may be provided with the projection at only one position or at more than three positions.

Back end walls 84, 79 (See FIG. 6) of the projections 80, 81 are butted against front end faces 86 of the props 13, and the bottom face of the scanner casing 20 in an area backward of the projections 80, 81 is butted against upper end faces 87 of the props 13, whereby the scanner unit 12 is held in such a manner that the plane 90 including the table face of the original table 22 may be horizontally kept.

When a vertically downward force is applied to the original table 22, the side walls 83 of the projections 80, 81 prevent the bottom of the scanner casing 20 from being flexed with the force, because the side walls are plate-shaped in parallel with an axis of direction of the force. Moreover, when a force for pressing down the front end part of the scanner casing 20 is exerted in a state where the back end part of the scanner casing 20 is connected to the props 13 by the hinges, stresses acting on the side walls 83 of the projections 80, 81 become larger in a backward direction. Due to the triangular shape of the side walls 83 which is broader in the backward direction, the stresses caused by the force for pressing down the front end part of the scanner casing 20 are made uniform.

The back end walls 84 of the projections 80, 81 including the side walls 83 are supported by the front end faces 86 of the props 13. The back end wall 84 of the projection 80 is plate-shaped extending downward in a direction away from a rotation center line of the scanner casing 20, in a state where the plane 90 including the table face of the original table 22 is horizontally kept. Specifically, the plate-shaped back end wall 84 is inclined downward from the back side to the front side of the hybrid machine 1. When the force for pressing down the front end part of the scanner casing 20 is exerted in a state where the back end part of the scanner casing 20 is connected to the props 13 by the hinges, the bottom of the scanner casing 20 is likely to be flexed in such a manner that the front end part of the bottom of the scanner casing 20 may approach the props 13. On this occasion, the force for pressing down the front end part of the scanner casing 20 is exerted on the scanner casing 20, as compression stresses on the side walls 83 of the projections 80, 81 in a longitudinal direction thereof, because the back end walls 84 of the projections 80, 81 are abutted against the front end faces 86 of the props 13. Because the side walls 83 of the plate-shaped projections 80, 81 are in parallel with an axis of the longitudinal direction, the scanner casing 20 is prevented from being flexed with the force for pressing down the front end part of the scanner casing 20, in such a manner that the front end part of the bottom of the scanner casing 20 may approach the props 13.

Figure 9:
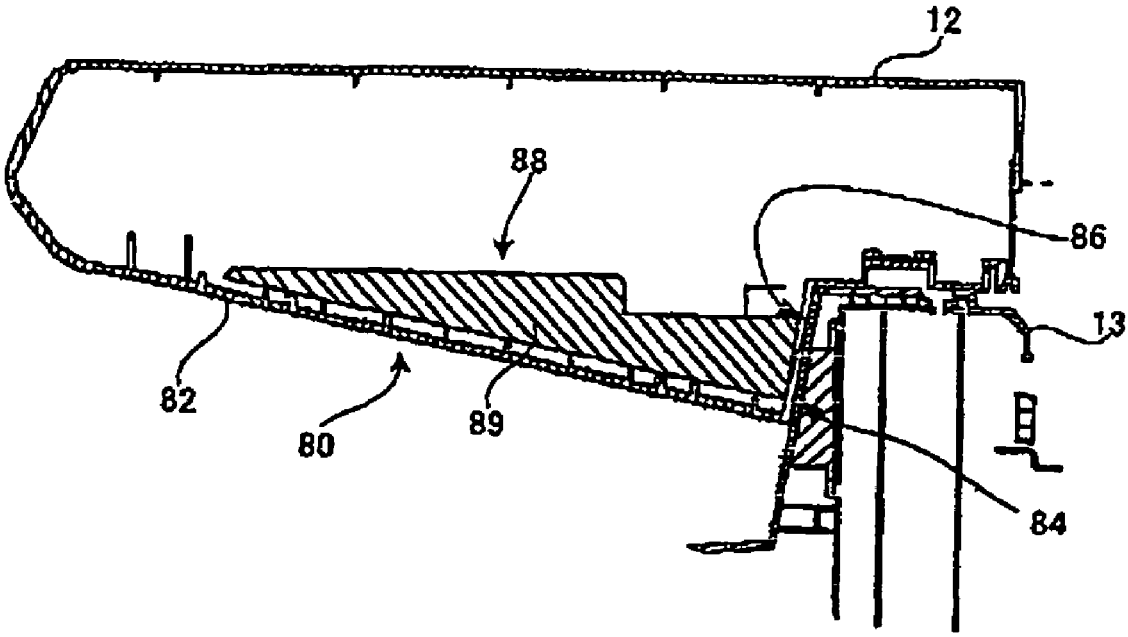
FIG. 9 is a section view of a scanner casing in the hybrid machine of FIG. 1.

The props 13 have the front end faces 86 which support the back end walls 84 of the projections 80, 81. The front end faces 86 are faces which are inclined with respect to a vertical direction at a same angle as the back end walls 84 of the projections 80, 81. As shown in FIG. 9, the projections 80, 81 are hollow, and the lower end walls 82, 85 and the back end walls 84 are reinforced from inside by reinforcing members 88 which are formed of sheet metal. Each of the reinforcing members 88 has a flat plate part 89 which is parallel to the side walls 83 of the projections 80, 81. The flat plate part 89 of the reinforcing member 88 prevents flexure of the scanner casing 20 as well as the side walls 83 of the projections 80, 81. It is to be noted that the projections 80, 81 may be made solid, and the reinforcing member 88 may be omitted.

Figure 10A:
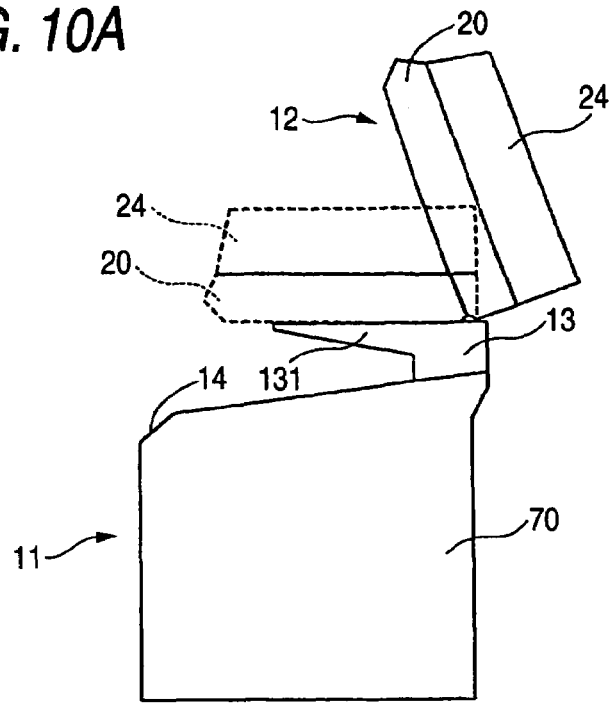
RELATED ART FIG. 10A
FIGS. 10A and 10B are schematic views for explaining disadvantages in the conventional structure.
Figure 10B:
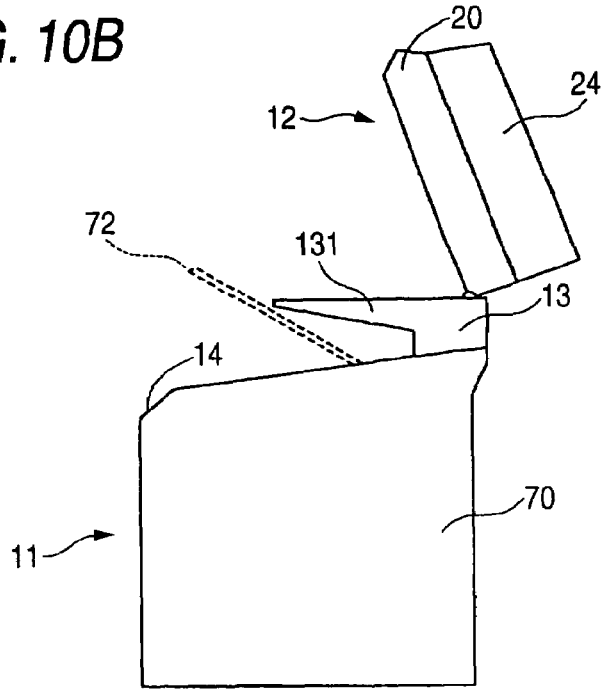
RELATED ART FIG. 10B

According to the hybrid machine 1 in this embodiment, the scanner casing 20 is tiltably connected to the props 13, and structural units (the projections 80, 81) for preventing flexure of the scanner casing 20 are integrally provided on the scanner casing 20. As the results, on occasion of performing maintenance of the interior of the printer casing 70, workability can be improved. For example, by providing a cantilever beam 131 on the prop 13 as shown in FIG. 10A, it is also possible to prevent flexure of the scanner casing 20. However, when the user lifts the front end part of the scanner casing 20, as shown in FIG. 10B, to perform maintenance work of the interior of the printer casing 70, the cantilever beam 131 remains near the printer casing 70 and would be an obstacle for the work.

As described above, according to the first embodiment of the invention, the scanner casing 20 is provided with the projections 80, 81 on the bottom face thereof, and the back end walls 84 of the projections 80, 81 are supported by the front end walls 86 of the props 13. In this manner, it is possible to enhance the rigidity of the scanner casing 20, and to prevent flexure of the scanner casing when the original is read. Moreover, because the scanner casing 20 is pivotably connected to the props 13, and the opening is formed in the upper part of the printer casing 70, the space above the printer unit 11 can be widely used to perform maintenance of the printing section. As the results, there is no necessity of moving the printer unit 11 for the purpose of maintenance, and therefore, the space for installation can be minimized. Further, because the printer unit 11 ejects the sheets of paper to the upper part of the printer casing 70, the installation space can be minimized.

Figure 11A:
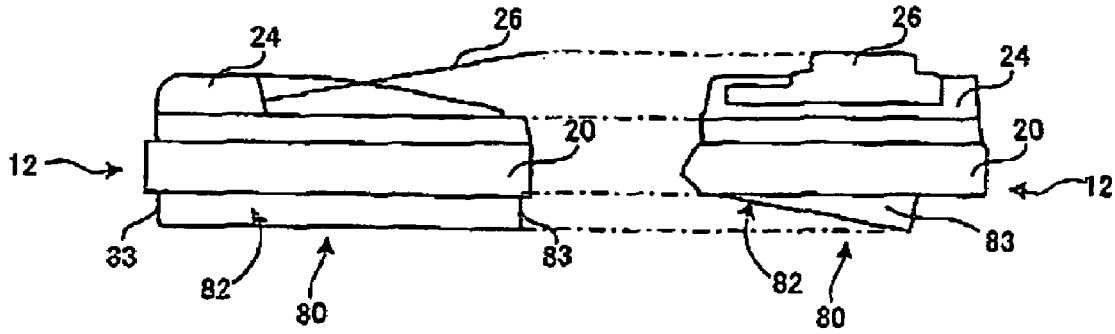
FIG. 11A is a schematic view of a scanner unit according to a second embodiment of the invention.
Figure 11B:
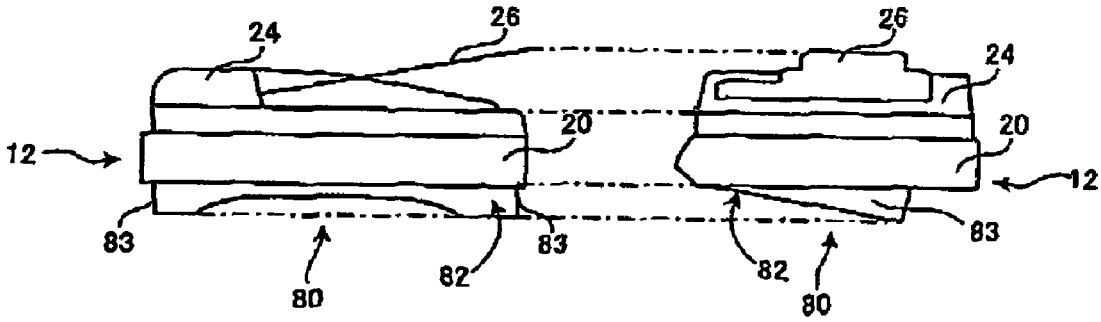
FIG. 11B is a schematic view showing a modified example of the scanner unit of FIG. 11A.

FIGS. 11A and 11B are front views and side views of the scanner unit 12 and the ASF unit 24 of the hybrid machine 1, as an image forming apparatus according to a second embodiment of the invention. As shown in FIG. 11A, the projection 80 for preventing flexure of the scanner casing 20 is a piece of projection which covers almost all part of the bottom of the scanner casing 20. The side walls 83 of the projection 80 are in a shape of a triangular plate, extending in parallel with each other from the front end to the back end of the scanner casing 20 and at a right angle with respect to the plane 90 including the table face of the original table 22. Therefore, the lower end wall 82 in a front part of the projection 80 has a flat face inclined downwardly in a direction from the front face to the back face of the hybrid machine 1. Moreover, the lower end wall 82 in the front part of the projection 80 may be formed with a curved face having an upward convex shape, as shown in FIG. 11B.

Figure 12:
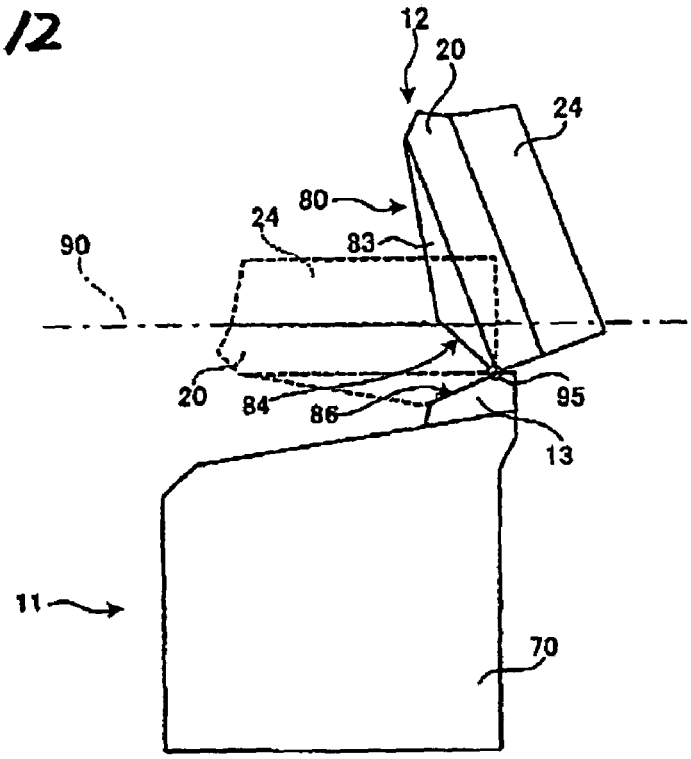
FIG. 12 is a schematic view of a hybrid machine according to a third embodiment of the invention.

FIG. 12 is a schematic side view of the hybrid machine 1, as an image forming apparatus according to a third embodiment of the invention. The back end wall 84 of the projection 80 provided on the bottom face of the scanner casing 20 is inclined downwardly in a forward direction from a position near a hinge 95 which connects the scanner casing 20 to the prop 13, in a horizontal state of the original table 22. Because the back end wall 84 of the projection 80 is abutted against the front end face 86 of the prop 13, the scanner unit 12 is supported in such a manner that the plane 90 including the table face of the original table 22 may be horizontally kept.

Figure 13:
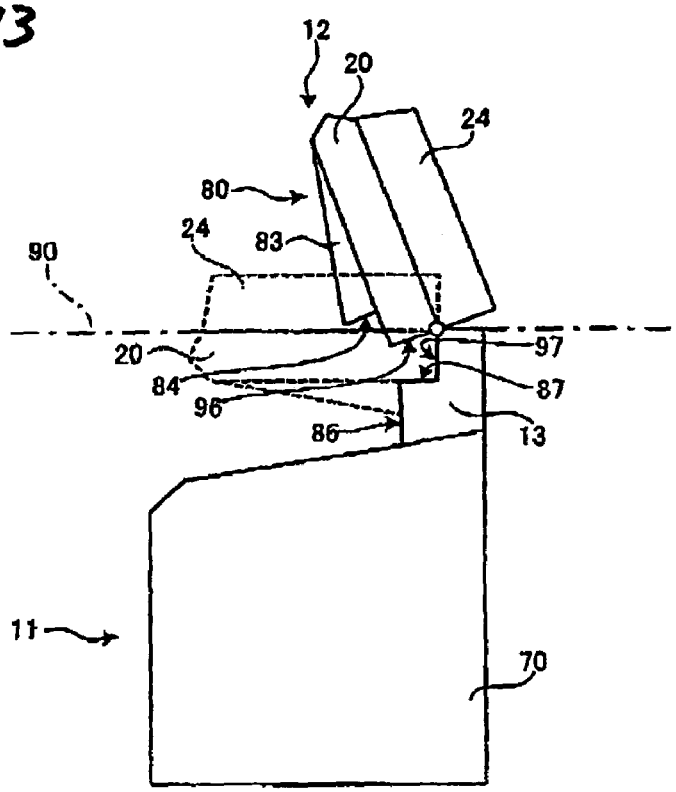
FIG. 13 is a schematic view of a hybrid machine according to a fourth embodiment of the invention.

FIG. 13 is a schematic side view of the hybrid machine 1, as an image forming apparatus according to a fourth embodiment of the invention. The scanner casing 20 is pivotably connected to the prop 13 at an upper position of its back face 96. The back end wall 84 of the projection 80 is abutted against an end face 86 of the prop 13. A part of the bottom face of the scanner casing 20 backward of the projection 80 is abutted against an end face 87 of the prop 13. The back face 96 of the scanner casing 20 is abutted against an end face 97 of the prop 13. The scanner unit 12 is supported in such a manner that the plane 90 including the table face of the original table 22 may be horizontally kept.

Although the hybrid machines have been described, by way of illustration, as the image forming apparatus in the above described embodiments of the invention, it is also possible to apply the invention to a copying machine. Moreover, although the structure in which microphotograph system is employed as the image capturer has been described by way of illustration, it is also possible to employ a contact type image sensor to compose the image capturer.

What is claimed is:

1. An image forming apparatus, comprising:

a printer unit;

a prop, extending from the printer unit upwards;

an upper casing, a rear end portion of which is coupled with an upper portion of the prop pivotably in a vertical direction;

a transparent platen, provided on a top face of the upper casing;

an image capturer, provided in the upper casing and operable to capture an image on an original disposed on the platen and to output image data;

a projection, provided on a bottom face of the upper casing and extending in a front-rear direction of the upper casing, the projection having a rear end face adapted to be supported by the prop when the upper casing is placed in a first position causing the platen to extend horizontally, wherein the rear end face extends obliquely in a forward-downward direction.

2. The image forming apparatus as set forth in claim 1, wherein a lower end face of the projection obliquely extends from a lower end of the rear end face in a forward-upward direction.

3. The image forming apparatus as set forth in claim 1, wherein the prop has a front end face obliquely extends in a forward-downward direction, so that the rear end face of the projection comes in contact with the front end face when the upper casing is placed in the first position.

4. The image forming apparatus as set forth in claim 1, wherein the prop has a top end face adapted to support a portion of the bottom face of the upper casing that is closer to a rear end of the upper casing than the projection, when the upper casing is placed in the first position.

5. The image forming apparatus as set forth in claim 1, wherein the printer unit is configured to eject a printing medium from a top portion thereof.

6. The image forming apparatus as set forth in claim 1, wherein the printer unit comprises:

a lower casing, having an opening at a top portion thereof;

a cover, coupled with the lower casing pivotably in the vertical direction and adapted to open or close the opening; and a print engine, accommodate in the lower casing so as to be exposed from the opening when the cover opens the opening, and operable to print the image data on a printing medium.

* * * * *